US005113549A

United States Patent [19]

Villiano

[11] Patent Number: 5,113,549

[45] Date of Patent: May 19, 1992

[54] DETACHABLE HANDLE FOR PAINT ROLLER PAN

[76] Inventor: Mark J. Villiano, 327 Falcone Ave., Roseto, Pa. 18013

[21] Appl. No.: 671,465

[22] Filed: Mar. 19, 1991

[51] Int. Cl.[5] ..... B65D 25/28

[52] U.S. Cl. ..... 96/114 R; 220/94 R

[58] Field of Search ..... 16/114 R, 114 A, 111 R; 220/94 R

[56] References Cited

U.S. PATENT DOCUMENTS 3,619,852 11/1971 Eckberg ..... 16/114
4,023,702 5/1977 McKnight ..... 16/114 R
4,919,298 4/1990 Gregory ..... 220/94 R

FOREIGN PATENT DOCUMENTS 15924 of 1929 Australia ..... 16/114 R

*Primary Examiner*—Robert L. Spruill

*Assistant Examiner*—Carmine Cuda

*Attorney, Agent, or Firm*—Daniel M. Kennedy

[57] ABSTRACT

A paint roller pan detachable handle or lifter has been discovered that facilitates convenient and rapid movement of paint roller pans when they are filled or partially filled with paint. The configuration of the handle is such that the paint roller pan can be lifted and carried with one hand without bending over to pick up the pan, thereby reducing the risk of paint spills and speeding the application of paint. The novel handle contains features that engage the rim and bottom of the pan and releasably hold the pan. A rim engaging clamp that is slidably attached to an upright portion of the handle provides means for rapid detachment of the handle from the paint roller pan. In one embodiment of the novel handle of the invention the upper portion of the handle contains a means, such as an arcuate surface, for retaining a paint roller handle such that the paint roller and paint roller pan can be carried together.

15 Claims, 2 Drawing Sheets

DETACHABLE HANDLE FOR PAINT ROLLER PAN

This invention relates to painting equipment, particularly paint roller pans or trays. The invention specifically relates to removable or detachable handles for use with paint roller pans to facilitate moving during the course of painting operations.

BACKGROUND OF THE INVENTION

The paint roller and paint roller pan or tray have become the ubiquitous tools of choice for the application of paint in industrial, commercial and residential installations. The paint roller and roller pan are preferred tools for both professional painters and do-it-yourself painters as they combine a rapidity for paint application with low cost and versatility of surface finish not readily achieved by painting by brush or spray painting. Commercial and residential painting by professional painters still may include a significant proportion of paint application by spraying. However, the techniques and equipment for painting by means of roller have evolved to a point where roller application is the typical choice. Rollers and roller pans now come in a wide variety of sizes including pans used by professional painters that will hold over a gallon of paint. Also, the paint roller can be purchased in a wide variety of nap-types offering a variability in the texture of the finished paint surface that is difficult to duplicate by brush or spray. The paint roller handle has been easily adapted to accommodate an extension pole whereby ceilings and upper walls can be painted without resort to ladders or scaffolding.

The use of a paint roller is not constrained to the companion use of a paint roller tray or pan. At the option of the painting contractor, paint may be applied by roller directly from the five gallon paint bucket which is a popular container for paint as purchased for commercial applications. Rigid screens are available that can be placed over a part of the top of an opened five gallon can of paint whereby the painter can soak the roller in the paint and squeeze off excess paint by rolling on the screen. This method works very well and avoids the use of paint roller pans or trays when large quantities of paint of the same color are being applied. However, when the use of ladders and/or scaffolding is required to reach ceilings or other places beyond the reach of extension poles the use of five gallon buckets can be hazardous or completely unacceptable. In those instances recourse must be made to the familiar roller pan. When quantities less than five gallons of a specific color are to be applied it is usually most convenient to use a roller pan.

As with any labor intensive task, the profitability of a specific job for a painting contractor is closely related to how quickly and neatly the journeyman painter can apply paint to the structure using a paint roller and pan. Profitability for the contractor, even business solvency, is also related to the frequency and seriousness of accidental paint spills. When repainting surfaces such as those in commercial office buildings or residences, accidental paint spillage can be very costly to clean up and sour contractor/client relationships. Accordingly, it behooves the painting contractor and journeyman painter to do all that is possible to paint the structures as rapidly as possible, but without increasing the frequency of paint spillage.

A major impediment to the journeyman painter in applying paint is the frequency and care associated with moving a paint roller pan that is filled or partially filled with paint. This task is repeated many times during the course of a paint job. The pan is unwieldy and usually must be picked up and carried with two hands since a commercial roller pan filled with paint can weigh between six and ten pounds and have a bottom surface area of about 1.5 square feet. Even when partly filled the pan is preferably grasped at two points to avoid inadvertent wobbling and spillage. After safely relocating the pan in a new, convenient position the painter must then go back and retrieve his roller which, if it contains an extension handle, can not be transported with the pan. The time and motion involved in the sequence of events required to relocate a paint roller pan adjacent to a surface to be painted represents a significant part of the total time and motion involved to complete the entire painting operation and, therefore, a problem to be resolved. The problem is especially acute where a journeyman painter may be working on scaffolding. Under these conditions, bending down to pick up and move a roller paint pan with two hands must be done with extra care to avoid an injurious fall or spill. Consequently, painting operations carried out on scaffolding are particularly slowed due to the problems associated with relocating the paint roller pan.

Any modifications to paint roller pans that are applied to overcome the foregoing problems are complicated by the traditional routine of the journeyman painter and the painting contractor in cleaning, stacking and storing the many paint roller pans customarily carried in the contractor's vehicle. Appurtenances to the pan that, of themselves, create problems for the contractor are not desired.

Accordingly, it is an object of the present invention to provide a handle means for lifting and moving individual paint roller pans or trays.

It is another object of the invention to provide a readily detachable handle adaptable for use on conventional paint roller pans.

Yet another object of the present invention is to provide a detachable handle for paint roller pans that includes a means for retaining the handle of a paint roller such that it can be conveniently carried along with the paint roller pan.

SUMMARY OF THE INVENTION

A paint roller pan detachable handle or lifter has been discovered that facilitates convenient and rapid movement of paint roller pans when they are filled or partially filled with paint. The configuration of the handle is such that the paint roller pan can be lifted and carried with one hand without bending over to pick up the pan, thereby reducing the risk of paint spills and speeding the application of paint. The novel handle contains features that engage the rim and bottom of the pan and releasably hold the pan. A rim engaging clamp that is slidably attached to an upright portion of the handle provides means for rapid detachment of the handle from the paint roller pan. In one embodiment of the novel handle of the invention the upper portion of the handle contains a means, such as an arcuate surface, for retaining a paint roller handle such that the paint roller and paint roller pan can be carried together.

More particularly, a detachable paint roller pan lifter for moving a paint roller pan or tray has been discovered, comprising: an elongated vertical rod; a generally horizontal pan support means for engaging the exterior bottom of the roller pan, wherein the support means is connected to a bottom portion of the vertical rod; a pan rim engaging means for releasably retaining the support means in contact with the pan bottom, wherein the engaging means is operably connected to the vertical rod.

The invention further comprises a removable paint roller pan handle consisting of a shaped rod having two portions comprising a major vertical portion and a generally horizontal minor portion; a means for supporting the exterior bottom of said paint roller pan horizontally connected to the end of said vertical portion of said rod and disposed in the same direction as said minor portion of said rod; pan rim clamp means for releasably retaining the support means in contact with said pan bottom, wherein the clamp means is operably connected to the vertical portion of the rod. The pan rim clamp means comprises an angular member of predetermined length having a first side containing an aperture therein and disposed horizontally in a direction opposite to that of said pan support means in a plane parallel to the plane of said pan support, and a second side disposed in a downward vertical direction in a plane parallel to the plane of said vertical portion of said rod, said vertical rod portion passing through said aperture whereby said rim clamp means is slidable connected to said rod.

In the invention the support means can be a plate and the pan rim clamp means can be slidably connected to the vertical portion of the rod.

DESCRIPTION OF THE DRAWINGS

FIG. 1(*a*) is a drawing illustrating detail of an optional embodiment of the upper horizontal portion of the handle showing a curved surface as one means for retaining a paint roller handle and roller assembly.

DETAIL DESCRIPTION OF THE INVENTION

Figure 1:
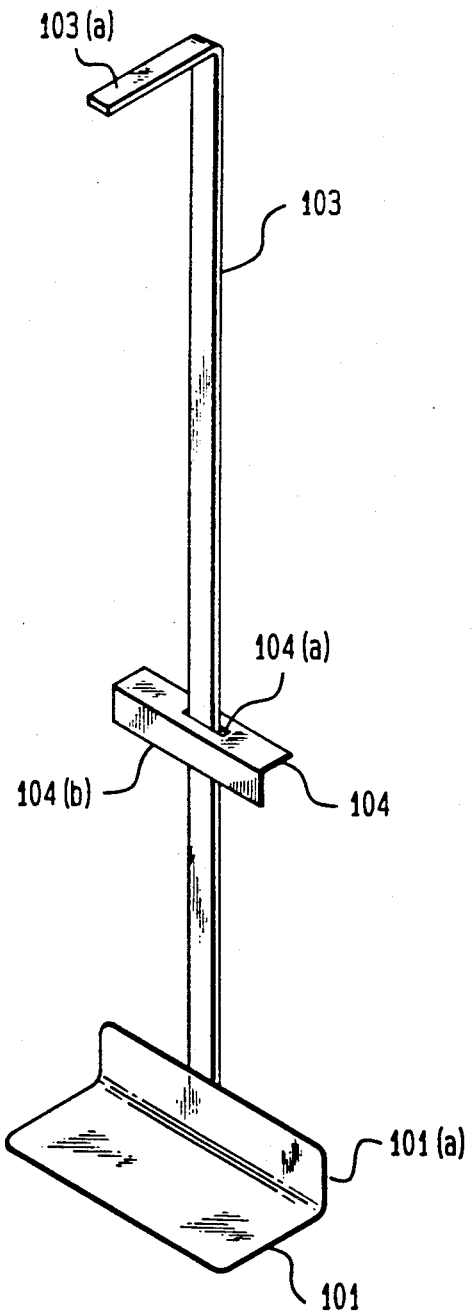
FIG. 1 is a schematic drawing of a preferred embodiment of the paint roller pan detachable handle of the present invention.
Figure 1:
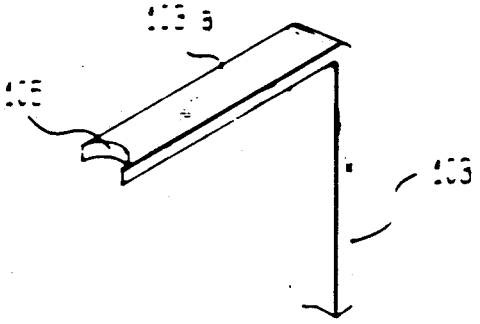

The present invention comprises a unique, cost effective apparatus for resolving a combination of associated problems in the utilization of paint roller pans not found to be apparent in the art heretofore. While paint roller and roller pans have been and will continue to be a mainstay tool for the application of paint for many years, little has been done to further facilitate their use and exploit their capability to quickly and safely apply paint. For all practical purposes, the paint roller pan in use today is nearly identical with that in use nearly a generation ago. Problems associated with the use of paint rollers and roller pans or trays have gone unappreciated and unresolved until the discovery of the instant invention. The specific problems have been described herein before. These problems are very much tied in with the prescribed shape of paint roller pans and the manner in which they are used with paint rollers.

For purposes of reference in describing the operation of the instant invention, paint roller pans can be described as a pan rectangular in shape and having a perimeter of upwardly extending walls terminating in a rim. The pan bottom has a slanted portion and a flat portion which constitutes the well of the pan for containing the bulk of liquid paint. A paint roller is dipped into the well and excess paint removed by rolling the roller on the slanted portion of the pan. Conventionally, the pan has two legs supporting the shallow end of the pan to keep the pan essentially horizontal and level. The well end, or deep end of the pan usually rests on the surface or it may have two legs shorter than those at the opposite end.

As described herein, the instant invention is referred to as a pan handle or pan lifter. These terms are intended to include the sum total of all the parts of the invention and should not be construed to mean only that part of the apparatus that is grasped by hand.

The handle or lifter of the instant invention includes a platform portion the function of which is to support the pan in contact with the exterior bottom of the pan. The handle of the invention also includes a means that works in consort with the platform to hold the pan unto the platform. These elements of the handle are integrated through an appurtenance that can be easily grasped by the painter and used to carry the combined lifter and roller pan.

The platform portion of the handle of the invention is preferably a rectangular flat plate of metal, plastic or wood construction of a size sufficient to easily fit under the well portion of the bottom of the roller pan and so bear the load of that portion of the pan containing the largest part of the paint in the pan. Configurations other than rectangular plate can also be used for the platform portion of the invention. Platforms comprising circular grills or multiple prongs can also be used. Preferably, the platform will have a right angle bend abutting the well end of the pan that restrains movement of the pan in that direction.

That part of the lifter of the invention which serves as the means to hold or retain the pan on the platform portion of the lifter is preferably designed to incorporate the easy detachability feature of the invention. It has been discovered that pan rim clamps are particularly suited for this function. When the rim clamp is in place on the rim and either directly or indirectly connected to the platform the opposing forces securely hold the pan in place on the platform. A preferred rim clamp is one that comprises a metal or plastic strip having a right angle or semicircular cross-section. One edge of the strip straddles the pan rim while the other edge is connected to the platform. The pan cannot rotate counterclockwise through a vertical axis and is therefore immobile on the platform.

A particularly effective and preferred rim clamp is a length of angle iron or plastic shorter than the width of the roller pan, where the angle iron has a cross-section in the shape of the letter L or the letter U. One edge of the angle iron straddles the front well end rim of the pan and the other side or edge of the angle iron is connected to the platform, directly or indirectly. The most preferred rim clamp is angle iron having a cross-section in the shape of the letter L. Further, the pan rim engaging means comprises an angular member of predetermined length having a first side containing an aperture therein and disposed horizontally in a direction opposite to that of the pan support means in a plane parallel to the plane of the pan support, and a second side disposed in a downward vertical direction in a plane parallel to the plane of the vertical rod, said vertical rod passing through the aperture whereby the rim engaging means is slidable connected to said rod.

In the apparatus of the invention the rim clamp and platform are preferably connected through independent connections to the means by which a painter grasps and lifts the apparatus. It is more convenient in paint operations using the invention to place the locus for grasping the handle at an elevation two or three feet above the floor to reduce the amount of bending the painter must do. However, the locus can be placed adjacent to the pan, if so desired, without departing from the spirit and purpose of the invention. Preferably the locus for grasping and carrying the apparatus will be at one end of an elongated vertical rod, the other end of which is connected to the rim clamp and platform. It has been discovered that the vertical rod, rim clamp and platform can be integrated and connected to provide a highly effective lifter with a convenient means for detaching the lifter from a pan by slidably connecting the rim clamp to the rod. This, it has been discovered, can be accomplished by having an aperture in an angle iron rim clamp through that face or side of the clamp that is essentially horizontal and lying in a direction opposite to that of the platform when the clamp is in a position straddling the pan rim to hold the pan on the platform. The rod passes through the aperture in the rim clamp such that the clamp can slide up to release the pan and remove the handle.

Optionally, the elongated vertical rod to which the rim clamp and platform are connected may have the shape of an inverted letter L with the horizontal upper portion extending or disposed in the same direction as the platform. In this configuration the painter can grasp the handle directly over the center of gravity of the roller pan thereby achieving better control of the balance and level position of the pan.

In another embodiment of the present invention a modification has been discovered that further improves the utility of the invention. It has been discovered that when the upper portion of the vertical handle rod is modified to include a means for retaining the rod of a paint roller then the painter may simultaneous carry both roller and pan in one hand. This is particularly useful when extension handles are being used with a paint roller for the combination is awkward to carry when moving a full paint roller pan. The modification may take the form of a clamp connected to the upper end of the vertical rod of the lifter. It has also been discovered that if the end of the vertical rod contains an indented arcuate shape or other curved or notched shape disposed horizontally in a direction toward the upright portion of the vertical rod of the lifter, the roller extension rod handle can be retained there in a rest position while the roller itself rests in the pan. The entire assembly can be readily carried in this position.

Referring now to FIG. 1, a drawing is presented that illustrates a preferred embodiment of the instant invention. The roller pan lifter of FIG. 1 contains three major elements. The first major element is a platform the purpose of which is to support the paint roller pan by engaging the exterior bottom of the pan. As shown in FIG. 1 for this preferred embodiment, the platform basically comprises a rectangular plate 101 having an angular bend to provide a vertical portion 101(*a*) and a horizontal portion. The incorporation of a vertical portion to the plate of the platform is a convenient means to complete the support of the pan such that the front side of the well end of the pan can abut and rest against the vertical portion of the platform. The vertical portion of the platform also offers a convenient location to connect the platform to a second major element of the invention comprising an upright or vertical bar or rod 103. It should be understood that the combination of the platform and the bar or upright rod may be of unitary construction fabricated from a continuous piece of metal, plastic, plastic injection mold or wood. However, the platform can also be secured to the upright rod by any conventional means such as welds, bolts or adhesives to provide what is preferably a rigid construction capable of supporting a paint roller pan filled with paint. The size of the platform is predetermined according to the size of the roller pan with which it is to be used. If the well end of the roller pa does not have legs that could interfere with the insertion of the platform underneath the pan, the platform can be of any convenient width. Preferably, the platform is no wider than the width of the paint roller pan at the well end of the pan. The length of the platform should be sufficient to support the well end of the paint roller pan. Preferably, the total area of the horizonal portion of the platform is about 10–15 percent of the total area of the well end of the paint roller pan. It is to be understood that the length of the platform can extend beyond the well end of the pan in the direction of the slanted portion of the pan. Optionally, the platform may have a shape comprising a horizontal portion and a slanted portion that conforms to the well portion and the slanted portion of the roller pan itself.

The vertical rod 103 preferably extends upward for a length sufficient to provide a convenient height for a painter to grasp the handle without bending over. Most preferably, the top of the vertical rod is shaped to provide a horizontal portion 103(*a*) disposed in the direction of the platform and approximately parallel therewith. The portion 130(*a*) comprises a most convenient place for a painter to grasp the apparatus. When the horizontal portion 103(*a*) is disposed in the direction of the platform the combined weight of the roller pan and apparatus of the invention can be lifted directly over the pan wherein the center of gravity of the filled pan lies. Lifting and carrying the pan directly over the center of gravity is an advantageous position to control the balance of the pan and eliminate spilling paint. While it is preferred to provide a vertical rod 103 with a height convenient for use by a painter who is standing upright, the height of the handle can be substantially reduced so the horizontal portion of the vertical rod lies close to the surface of the pan. Handles so designed are efficaciously employed when working with roller pans that are resting on the trays of ladders.

The vertical rod 103 can be constructed of any material particularly metal, wood or plastic. Preferably the rod is of unitary construction such that the horizontal portion 103(*a*) is shaped by bending the vertical rod. Optionally the portion 103(*a*) may be connected by welding, bolting or the use of adhesives.

The apparatus of the invention includes an important feature comprising a slidable rim clamp 104 connected to the vertical rod 103 through an aperture 104(*a*) in the rim clamp. The vertical rod passes through the aperture and the clamp 104 can be readily moved up or down on the rod. The preferred rim clamp has a length less than the width of the roller pan and has a right angular cross sectional shape. The vertical side of the clamp containing the downward facing edge 104(*b*) is designed to straddle the rim of the roller pan thereby compressing the rim and holding the pan between the clamp and rod 103 while the pan rests upon platform 101.

Referring to FIG. 1(*a*), an optional and advantageous variation of the horizontal portion 103(*a*) of the vertical rod 103 of FIG. 1 is shown. The Figure illustrates a curved shape 105 comprising the end of the horizontal section 103(*a*). The end of 103(*a*) is preferably arcuate in shape with the apex of the arc disposed in a direction toward the vertical portion of rod 103. The arcuate indentation 105 should have a radius at least large enough to accommodate the extension handle of a paint roller which can be permitted to rest therein. While other shapes may be used to serve the same purpose as long as they are large enough to accommodate the handle of a paint roller, a horizontal curved end to section 103 (A) of the vertical rod is preferred.

Figure 2:
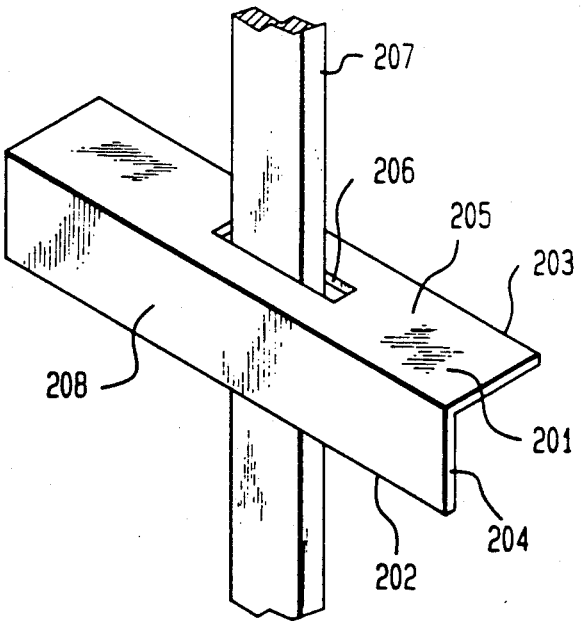
FIG. 2 is a drawing illustrating detail of the preferred embodiment of the slidable rim engaging clamp portion of the detachable handle of the invention.

Referring to FIG. 2, details of the slidable rim clamp of the present invention are illustrated. The FIG. 2 illustrates rim clamp 201 having a vertical edge 202 disposed in a downward direction and a horizontal edge 203 disposed in a direction opposite to that of direction of the platform. The horizontal face 205 of the clamp contains preferably an elongated aperture 206. Vertical rod 207, preferably comprising metal or plastic flat stock passes through aperture 206 with sufficient clearance between the vertical rod and the defining edges of the aperture to allow the clamp to be readily moved upward or downward on the vertical rod. The use of an elongated aperture parallel to edges 203 and 202 in conjunction with a flat vertical rod prevents horizontal or vertical rotation of clamp 201 and eliminating problems of engaging the clamp with the rim of the roller pan. In use, the clamp is simply allowed to drop over the rim of the roller pan such that edge 202 straddles the pan and the rim is locked between face 208 and rod 207.

Figure 3:
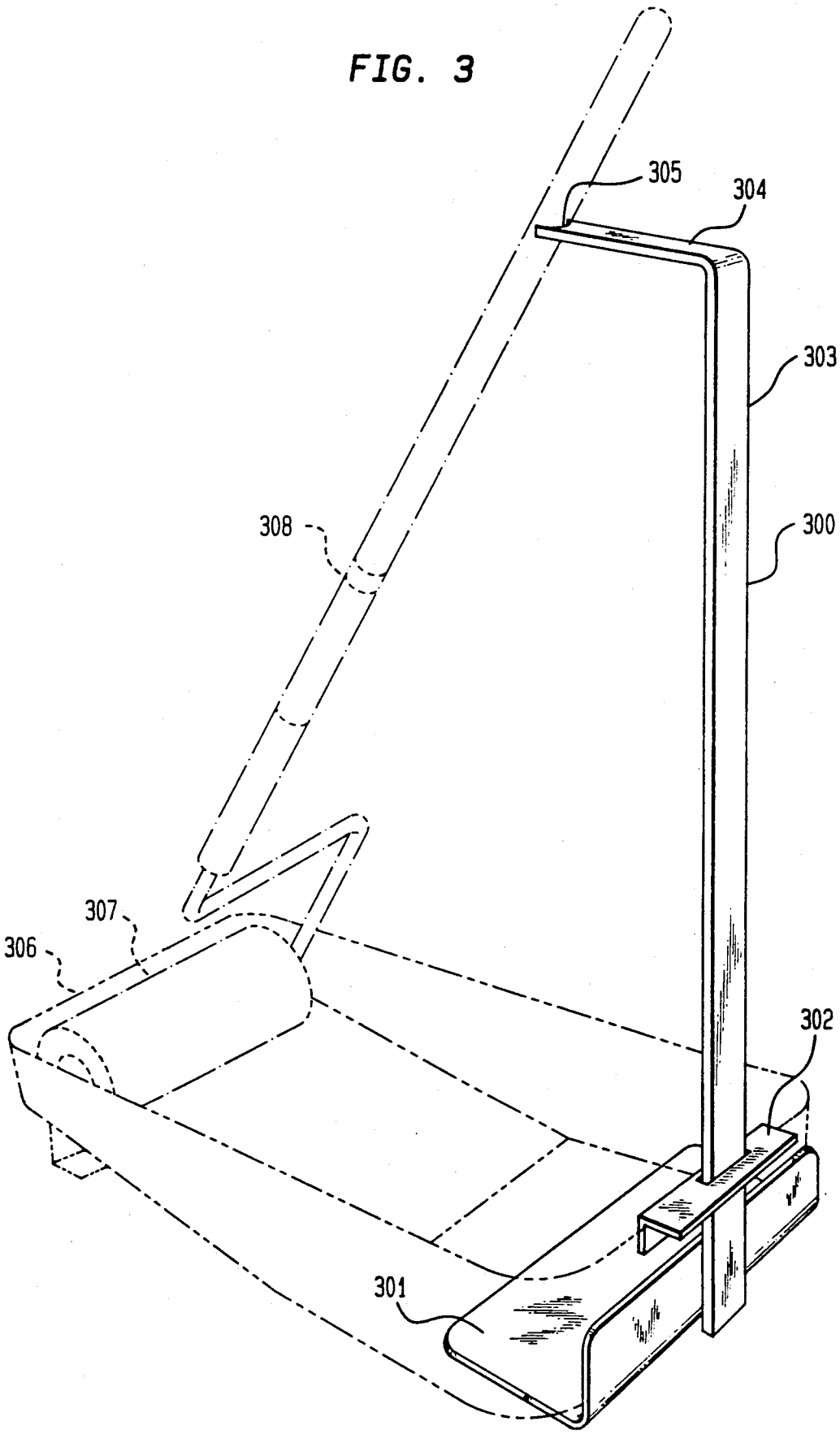
FIG. 3 is a drawing that illustrates the utilization of the detachable handle of the invention in releasably supporting a paint roller pan and providing means to retain and carry a paint roller handle along with the pan.

FIG. 3 illustrates the preferred embodiment of the present invention in use with a conventional paint roller pan 306 and a paint roller 307 containing an extension handle 308. The present invention is illustrated employing solid lines while the paint roller pan 306, roller 307, roller handle and extension pole 308 are outlined using dashed lines. FIG. 3 shows the invention 300 with platform 301 inserted underneath the pan and slidable rim clamp 302 straddling or overlapping the forward rim of the well portion of the pan. The vertical handle 303 contains a horizontal portion 304 that is disposed or lies in the same direction as platform 301. The horizontal portion 304 ends in a semi circular indentation 305. The extension handle of a paint roller rests in indentation 305 while a paint roller itself rests in the shallow end of the paint roller pan. The combination of the lifter of the present invention, the paint roller pan containing paint, the paint roller and extension handle can be easily lifted as a single unit at the horizontal portion of the handle 304.

The actual use of the invention is straight forward and apparent from the view of FIG. 3. The painter can place the roller pan on the platform 301 and with one hand slide clamp 302 upward and then down to engage the rim of the well end of the roller pan to hold the pan on the platform or plate 301. The well is filled with paint. If so desired the paint roller is rested in the shallow end of the pan and extension pole rested in the notch or indentation in the upper handle 305. The combination can be moved to the work place and conveniently moved to the next work place in the same manner quickly, easily and safely.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A detachable paint roller pan lifter for moving a paint roller pan or tray, comprising:

handle means for carrying said lifter, said handle means comprising a single vertical rod terminating in a free distal end;

roller pan support means for engaging a major portion of the exterior horizontal bottom portion of said pan, said support means connected to a proximal or bottom portion of said vertical rod in a generally horizontal position;

roller pan rim engaging means for releasably engaging a major portion of a side edge of said rim and retaining said support means in contact with said pan bottom, said engaging means slidably connected to said rod for vertical movement.

2. The pan lifter of claim 1 wherein said support means comprises an essentially flat, rectangular member.

3. The pan lifter of claim 2 wherein said support means comprises semicircular or circular rod.

4. The lifter of claim 1 wherein said distal end of said rod is horizontally disposed in the same direction as said pan support means.

5. The pan lifter of claim 4 wherein said horizontal rod terminates in a length less than that of said paint roller pan and the unconnected end of said horizontal rod contains means for retaining a paint roller handle.

6. The pan lifter of claim 5 wherein the means for retaining a paint roller handle comprises said unconnected end containing a horizontal arcuate shape, the apex of the arc of which is disposed in a direction toward said vertical rod.

7. The pan lifter of claim 1 wherein said pan rim engaging means comprises an angular member of length sufficient to engage said major portion of said rim side edge, said rim engaging means having a first side containing an aperture therein and disposed horizontally in a direction opposite to that of said pan support means and a second side disposed in a downward vertical direction, said vertical rod passing through said aperture whereby said rim engaging means is slidably connected to said rod for vertical movement.

8. A removable paint roller pan handle for moving a paint roller pan, comprising:

a single rod having a major vertical portion and a minor horizontal portion terminating in a free distal end;

means for supporting a major portion of the exterior horizontal bottom of said paint roller pan, said means horizontally connected to the bottom of said vertical portion of said rod and disposed in the same direction as said minor portion of said rod;

pan rim clamp means for releasably engaging a major portion of a side edge of said rim and retaining said support means in contact with said pan bottom, said clamp means slidably connected to said vertical portion of said rod.

9. The handle of claim 8 wherein said support means comprises a plate means.

10. The handle of claim 8 wherein said support means comprises linear, semicircular or circular rod.

11. The handle of claim 8 wherein said pan rim clamp means is slidably connected to said vertical portion of said rod.

12. The handle of claim 8 wherein said pan rim clamp means comprises an angular member of length sufficient to engage said major portion of said rim side edge, said rim clamp means having a first side containing an aperture therein and disposed horizontally in a direction opposite to that of said pan support means, and a second side disposed in a downward vertical direction, said vertical rod portion passing through said aperture whereby said rim clamp means is slidably connected to said rod.

13. The handle of claim 8 wherein said horizontal rod portion terminates in a length less than that of said paint roller pan and the end of said horizontal rod portion contains means for retaining a paint roller handle.

14. The handle of claim 13 wherein the means for retaining a paint roller handle comprises said end of said horizontal rod portion having a horizontal arcuate shape disposed in a direction toward said vertical rod portion.

15. A readily detachable paint roller pan handle for moving a paint roller pan, comprising:

a single upright rod having a major vertical portion and a minor horizontal portion terminating in a free or unconnected distal end, said rod having an essentially rectangular cross section;

plate means for supporting a major portion of the exterior horizontal bottom of said paint roller pan, said means horizontally connected to the bottom portion of said vertical portion of said rod and disposed in the same direction as said minor portion of said rod;

pan rim clamp means for releasably engaging a major portion of a side edge of said rim and retaining said plate means in contact with said pan bottom, said clamp means comprising an angular member having a first side and second side, said first side being disposed horizontally in a direction opposite to that of said pan support means and containing an aperture therein whereby said clamp means is slidably connected there through to said vertical portion of said rod for vertical movement, and a second side disposed in a downward vertical direction for a length sufficient to overlap said rim.

* * * * *